US011759789B1

(12) United States Patent
Young

(10) Patent No.: US 11,759,789 B1
(45) **Date of Patent: *Sep. 19, 2023**

(54) CURVED HAMMER

(71) Applicant: Genesis III, Inc., Prophetstown, IL (US)

(72) Inventor: Roger T. Young, Prophetstown, IL (US)

(73) Assignee: Genesis III, Inc., Prophetstown, IL (US)

( * ) Notice: Subject to any disclaimer, the term of this patent is extended or adjusted under 35 U.S.C. 154(b) by 150 days.

This patent is subject to a terminal disclaimer.

(21) Appl. No.: 17/115,385

(22) Filed: Dec. 8, 2020

Related U.S. Application Data

(63) Continuation of application No. 14/633,361, filed on Feb. 27, 2015, now Pat. No. 10,857,540, which is a continuation of application No. 14/067,622, filed on Oct. 30, 2013, now Pat. No. 8,998,120, which is a continuation of application No. 13/403,625, filed on Feb. 23, 2012, now Pat. No. 8,613,403, which is a continuation of application No. 12/786,202, filed on May 24, 2010, now Pat. No. 8,141,804.

(60) Provisional application No. 61/180,773, filed on May 22, 2009.

(51) Int. Cl.
*B02C 13/28* (2006.01)

(52) U.S. Cl.
CPC ..... *B02C 13/28* (2013.01)

(58) Field of Classification Search
CPC ..... B02C 13/28
See application file for complete search history.

(56) References Cited

U.S. PATENT DOCUMENTS

| | | | |
|---|---|---|---|
| 758,288 | A | 4/1904 | Williams |
| 858,772 | A | 7/1907 | Williams |
| 906,364 | A | 12/1908 | Williams |
| 1,016,979 | A | 2/1912 | Williams |
| 1,041,495 | A | 10/1912 | Liggett et al. |
| 1,085,692 | A | 2/1914 | Liggett |
| 1,266,894 | A | 5/1918 | Williams |

(Continued)

FOREIGN PATENT DOCUMENTS

| | | |
|---|---|---|
| DE | 10215833 | 4/2006 |
| EM | 30893151 | 3/2008 |

OTHER PUBLICATIONS

Jacobs Corporation. Advertisement. "The Pentagon Hammer System" Nov. 19, 2008.

*Primary Examiner* — Faye Francis
(74) *Attorney, Agent, or Firm* — Hamilton IP Law, PC.; Jay R. Hamilton

(57) ABSTRACT

The various embodiments disclosed and pictured illustrate a curved hammer for comminuting various materials. The illustrative embodiments pictured and described herein are primarily for use with a rotatable hammermill assembly. The curved hammer includes a connection portion having a rod hole therein, a contact portion for delivery of energy to the material to be comminuted, and a curved neck portion affixing the connection portion to the contact portion. In other embodiments, a shoulder is positioned around the periphery of the rod hole for added strength. In still other embodiments, a neck reinforcement is positioned along a portion of the neck for increased strength. A weld or plurality of welds may be affixed to various surfaces of the contact portion to aide in comminuting and/or longevity of the curved hammer.

9 Claims, 7 Drawing Sheets

(56) References Cited

U.S. PATENT DOCUMENTS

| | | | |
|---|---|---|---|
| RE14,865 | E | 6/1918 | Plaisted |
| RE14,920 | E | 4/1919 | Plaisted |
| 1,433,042 | A | 10/1922 | Sedberry |
| 1,444,990 | A | 2/1923 | Wauthier |
| 1,630,021 | A | 5/1927 | Lucas |
| 1,678,723 | A | 7/1928 | Clement |
| 1,693,058 | A | 11/1928 | Shelton |
| 1,759,905 | A | 5/1930 | Keith |
| 1,760,097 | A | 5/1930 | Williams |
| 1,761,038 | A | 6/1930 | Liggett |
| 1,787,526 | A | 1/1931 | Honstain |
| 1,821,912 | A | 9/1931 | Pfeiffer |
| 1,827,986 | A | 10/1931 | Inglehart |
| 1,829,325 | A | 10/1931 | Alfred |
| 1,854,844 | A | 4/1932 | Kaemmerling |
| 1,889,129 | A | 11/1932 | Christian |
| 1,911,718 | A | 5/1933 | Saunders |
| 1,954,175 | A | 4/1934 | Jensen |
| 1,997,553 | A | 4/1935 | Taylor et al. |
| 2,015,581 | A | 9/1935 | Armour |
| 2,207,455 | A | 7/1940 | Clement |
| 2,237,510 | A | 4/1941 | Tankersley |
| 2,244,577 | A | 6/1941 | Schreiber |
| 2,404,778 | A | 7/1946 | Allison |
| 2,531,597 | A | 11/1950 | Anderson |
| 2,566,758 | A | 9/1951 | Anderson |
| 2,566,798 | A | 9/1951 | Hiller |
| 2,602,597 | A | 7/1952 | Ball |
| 2,607,538 | A | 8/1952 | Larson |
| 2,763,439 | A | 9/1956 | Mankoff |
| 3,045,934 | A | 7/1962 | Eilers |
| 3,058,676 | A | 10/1962 | Hermann |
| 3,222,854 | A | 12/1965 | Barth |
| 3,278,126 | A | 10/1966 | Ratkowski |
| 3,322,356 | A | 5/1967 | Toews |
| 3,379,383 | A | 4/1968 | Stepanek |
| 3,482,789 | A | 12/1969 | Newell |
| 3,549,095 | A | 12/1970 | Ratkowski |
| 3,598,008 | A | 8/1971 | Jacobson et al. |
| 3,627,212 | A | 12/1971 | Stanton |
| 3,738,586 | A | 6/1973 | Fabert |
| 4,129,262 | A | 12/1978 | Lowry |
| 4,141,512 | A | 2/1979 | Francis |
| 4,142,687 | A | 3/1979 | Potwin |
| 4,162,767 | A | 7/1979 | Hahn |
| 4,177,956 | A | 12/1979 | Fawcett |
| 4,310,125 | A | 1/1982 | Novotny |
| 4,341,353 | A | 7/1982 | Hamilton et al. |
| 4,343,438 | A | 8/1982 | Slikas et al. |
| 4,352,774 | A | 10/1982 | Hornberger |
| 4,406,415 | A | 9/1983 | Greer |
| 4,558,826 | A | 12/1985 | Martinek |
| 4,729,516 | A | 3/1988 | Williams, Jr. |
| 4,795,103 | A | 1/1989 | Lech |
| 4,856,170 | A | 8/1989 | Kachik |
| 4,907,750 | A | 3/1990 | Seifert |
| 4,915,310 | A | 4/1990 | Stelk |
| 5,002,233 | A | 3/1991 | Williams |
| 5,072,888 | A | 12/1991 | Stelk |
| 5,364,038 | A | 11/1994 | Prew |
| 5,377,919 | A | 1/1995 | Rogers et al. |
| 5,381,975 | A | 1/1995 | Chon |
| 5,443,216 | A | 8/1995 | Lajoie |
| 5,465,912 | A | 11/1995 | Graybill |
| 5,605,291 | A | 2/1997 | Doskocil |
| 5,611,496 | A | 3/1997 | Fleenor |
| 5,628,467 | A | 5/1997 | Graveman |
| 5,692,688 | A | 12/1997 | Waitman et al. |
| 5,722,607 | A | 3/1998 | Hellmich |
| 5,842,653 | A | 12/1998 | Elliott et al. |
| 5,904,306 | A | 5/1999 | Elliott et al. |
| 6,045,072 | A | 4/2000 | Zehr |
| 6,131,838 | A | 10/2000 | Balvanz |
| 6,142,400 | A | 11/2000 | Balvanz et al. |
| 6,260,778 | B1 | 7/2001 | Wenger |
| 6,299,082 | B1 | 10/2001 | Smith |
| 6,364,227 | B1 | 4/2002 | Dorscht |
| 6,419,173 | B2 | 7/2002 | Balvanz et al. |
| 6,481,654 | B1 | 11/2002 | Balvanz |
| 6,517,020 | B1 | 2/2003 | Smith |
| 6,622,951 | B1 | 9/2003 | Recker |
| 6,971,598 | B2 | 12/2005 | Schillinger et al. |
| 7,140,569 | B2 | 11/2006 | Young |
| D536,350 | S | 2/2007 | Young |
| D536,351 | S | 2/2007 | Young |
| D536,352 | S | 2/2007 | Young |
| D544,503 | S | 6/2007 | Young |
| D544,504 | S | 6/2007 | Young |
| D545,327 | S | 6/2007 | Young |
| D545,328 | S | 6/2007 | Young |
| D545,846 | S | 7/2007 | Young |
| D545,847 | S | 7/2007 | Young |
| D550,728 | S | 9/2007 | Young |
| D551,266 | S | 9/2007 | Young |
| D551,267 | S | 9/2007 | Young |
| D552,638 | S | 10/2007 | Willibald |
| 1,552,639 | A1 | 10/2007 | Young |
| D555,679 | S | 11/2007 | Young |
| 7,325,761 | B2 | 2/2008 | Chen et al. |
| D573,163 | S | 7/2008 | Young |
| 7,419,109 | B1 | 9/2008 | Ronfeldt et al. |
| D588,174 | S | 3/2009 | Young |
| 7,559,497 | B2 | 7/2009 | Young |
| 7,621,477 | B2 | 11/2009 | Young |
| D616,002 | S | 5/2010 | Willibald |
| 7,819,352 | B2 | 10/2010 | Young |
| 2002/0190148 | A1 | 12/2002 | Roozeboom et al. |
| 2004/0017955 | A1 | 1/2004 | Schillinger et al. |
| 2006/0032958 | A1 | 2/2006 | Young |
| 2007/0023554 | A1 | 2/2007 | Young |
| 2009/0321546 | A1 | 12/2009 | Plumb et al. |
| 2010/0025511 | A1 | 2/2010 | Young |
| 2010/0090047 | A1 | 4/2010 | Willibald |
| 2010/0213301 | A1 | 8/2010 | Hoice et al. |
| 2011/0042498 | A1 | 2/2011 | Young et al. |

CURVED HAMMER

CROSS REFERENCE TO RELATED APPLICATIONS

The present non-provisional patent application claims priority from and is a continuation of U.S. patent application Ser. No. 14/633,361 filed on Feb. 27, 2015 (now U.S. Pat. No. 10,857,540), which application claims priority from and is a continuation of U.S. patent application Ser. No. 14/067,622 filed on Oct. 30, 2013 (now U.S. Pat. No. 8,998,120), which application was a continuation of and claimed priority from U.S. patent application Ser. No. 13/403,625 filed on Feb. 23, 2012 (now U.S. Pat. No. 8,613,403), which application was a continuation of and claimed priority from U.S. patent application Ser. No. 12/786,202 filed on May 24, 2010 (now U.S. Pat. No. 8,141,804), which application claimed priority from provisional U.S. Pat. App. No. 61/180,773 filed on May 22, 2009, all of which are incorporated by reference herein in their entireties.

FIELD OF INVENTION

This invention relates generally to a device for comminuting or grinding material. More specifically, the invention is especially useful for use as a hammer in a rotatable hammermill assembly.

STATEMENT REGARDING FEDERALLY SPONSORED RESEARCH OR DEVELOPMENT

No federal funds were used to develop or create the invention disclosed and described in the patent application.

REFERENCE TO SEQUENCE LISTING, A TABLE, OR A COMPUTER PROGRAM LISTING COMPACT DISK APPENDIX

Not Applicable

BACKGROUND

A number of different industries rely on impact grinders or hammermills to reduce materials to a smaller size. For example, hammermills are often used to process forestry and agricultural products as well as to process minerals, and for recycling materials. Specific examples of materials processed by hammermills include grains, animal food, pet food, food ingredients, mulch and even bark. This invention although not limited to grains, has been specifically developed for use in the grain industry. Whole grain corn essentially must be cracked before it can be processed further. Dependent upon the process, whole corn may be cracked after tempering yet before conditioning. A common way to carry out particle size reduction is to use a hammermill where successive rows of rotating hammer like devices spinning on a common rotor next to one another comminute the grain product. For example, methods for size reduction as applied to grain and animal products are described in Watson, S. A. & P. E. Ramstad, ed. (1987, Corn: Chemistry and Technology, Chapter 11, American Association of Cereal Chemist, Inc., St. Paul, Minn.), the disclosure of which is hereby incorporated by reference in its entirety. The application of the invention as disclosed and herein claimed, however, is not limited to grain products or animal products.

Hammermills are generally constructed around a rotating shaft that has a plurality of disks provided thereon. A plurality of free-swinging hammers are typically attached to the periphery of each disk using hammer rods extending the length of the rotor. With this structure, a portion of the kinetic energy stored in the rotating disks is transferred to the product to be comminuted through the rotating hammers. The hammers strike the product, driving into a sized screen, in order to reduce the material. Once the comminuted product is reduced to the desired size, the material passes out of the housing of the hammermill for subsequent use and further processing. A hammer mill will break up grain, pallets, paper products, construction materials, and small tree branches. Because the swinging hammers do not use a sharp edge to cut the waste material, the hammer mill is more suited for processing products which may contain metal or stone contamination wherein the product the may be commonly referred to as "dirty". A hammer mill has the advantage that the rotatable hammers will recoil backwardly if the hammer cannot break the material on impact. One significant problem with hammer mills is the wear of the hammers over a relatively short period of operation in reducing "dirty" products which include materials such as nails, dirt, sand, metal, and the like. As found in the prior art, even though a hammermill is designed to better handle the entry of a "dirty" object, the possibility exists for catastrophic failure of a hammer causing severe damage to the hammermill and requiring immediate maintenance and repairs.

Hammermills may also be generally referred to as crushers—which typically include a steel housing or chamber containing a plurality of hammers mounted on a rotor and a suitable drive train for rotating the rotor. As the rotor turns, the correspondingly rotating hammers come into engagement with the material to be comminuted or reduced in size. Hammermills typically use screens formed into and circumscribing a portion of the interior surface of the housing. The size of the particulate material is controlled by the size of the screen apertures against which the rotating hammers force the material. Exemplary embodiments of hammermills are disclosed in U.S. Pat. Nos. 5,904,306; 5,842,653; 5,377,919; and 3,627,212.

The four metrics of strength, capacity, run time and the amount of force delivered are typically considered by users of hammermill hammers to evaluate any hammer to be installed in a hammermill. A hammer to be installed is first evaluated on its strength. Typically, hammermill machines employing hammers of this type are operated twenty-four hours a day, seven days a week. This punishing environment requires strong and resilient material that will not prematurely or unexpectedly deteriorate. Next, the hammer is evaluated for capacity, or more specifically, how the weight of the hammer affects the capacity of the hammermill. The heavier the hammer, the fewer hammers that may be used in the hammermill by the available horsepower. A lighter hammer then increases the number of hammers that may be mounted within the hammermill for the same available horsepower. The more force that can be delivered by the hammer to the material to be comminuted against the screen increases effective comminution (i.e. cracking or breaking down of the material) and thus the efficiency of the entire comminution process is increased. In the prior art, the amount of force delivered is evaluated with respect to the weight of the hammer.

Finally, the length of run time for the hammer is also considered. The longer the hammer lasts, the longer the machine run time, the larger profits presented by continuous processing of the material in the hammermill through reduced maintenance costs and lower necessary capital inputs. The four metrics are interrelated and typically tradeoffs are necessary to improve performance. For example, to increase the amount of force delivered, the weight of the hammer could be increased. However, because the weight of the hammer increased, the capacity of the unit typically will be decreased because of horsepower limitations. There is a need to improve upon the design of hammermill hammers available in the prior art for optimization of the four (4) metrics listed above.

SUMMARY OF THE INVENTION

It is an object of the present invention to provide a hammer for use in a rotatable hammermill assembly wherein the primary contact surface of the hammer remains normal to the screen of the hammermill assembly during rotation.

It is another object of the present invention to provide a hammer having a primary contact surface of greater area than the respective area of similar hammers.

Other objects and advantages of the present invention will, in part, be apparent from the specification when considered in conjunction with the drawings and claims hereof.

BRIEF DESCRIPTION OF THE FIGURES

In order that the advantages of the invention will be readily understood, a more particular description of the invention briefly described above will be rendered by reference to specific embodiments illustrated in the appended drawings. Understanding that these drawings depict only typical embodiments of the invention and are not therefore to be considered limited of its scope, the invention will be described and explained with additional specificity and detail through the use of the accompanying drawings.

DETAILED DESCRIPTION—LISTING OF ELEMENTS

Figure 1:
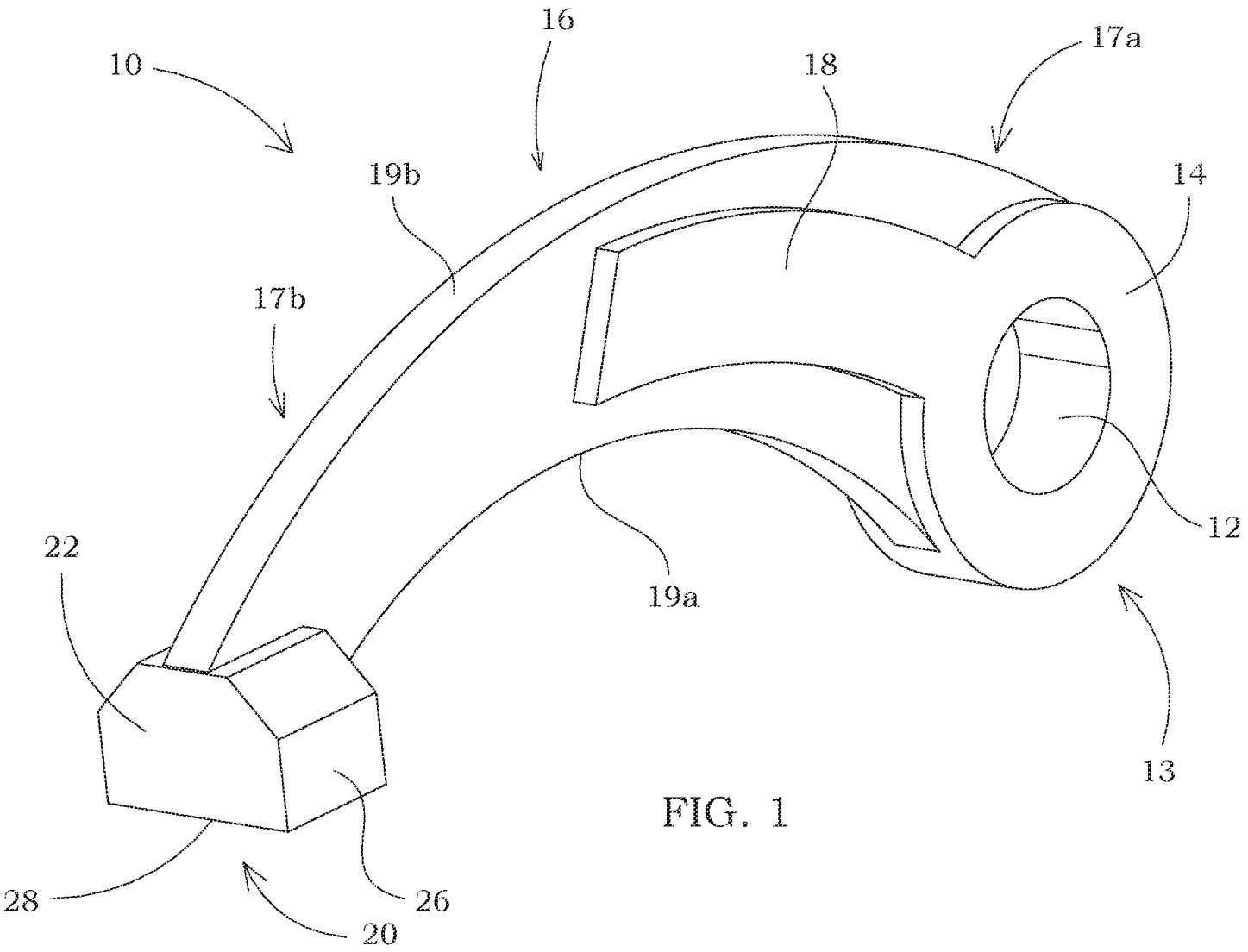
FIG. 1 provides a perspective view of a first embodiment of the curved hammer.

| Element | Element # |
|---|---|
| Curved hammer | 10 |
| Rod hole | 12 |
| Connection portion | 13 |
| Shoulder | 14 |
| Neck | 16 |
| Neck first end | 17a |
| Neck second end | 17b |
| Neck reinforcement | 18 |
| Neck bottom surface | 19a |
| Neck top surface | 19b |
| Contact portion | 20 |
| Primary contact surface | 22 |

-continued

| Element | Element # |
|---|---|
| Weld | 24 |
| Side contact surface | 26 |
| Bottom contact surface | 28 |
| Split connection portion | 50 |
| First arm | 52 |
| Second arm | 54 |
| Void | 55 |
| Tapered shoulder | 56 |

Detailed Description—Illustrative Embodiments

Before the various embodiments of the present invention are explained in detail, it is to be understood that the invention is not limited in its application to the details of construction and the arrangements of components set forth in the following description or illustrated in the drawings. The invention is capable of other embodiments and of being practiced or of being carried out in various ways. Also, it is to be understood that phraseology and terminology used herein with reference to device or element orientation (such as, for example, terms like "front", "back", "up", "down", "top", "bottom", and the like) are only used to simplify description of the present invention, and do not alone indicate or imply that the device or element referred to must have a particular orientation. In addition, terms such as "first", "second", and "third" are used herein and in the appended claims for purposes of description and are not intended to indicate or imply relative importance or significance. Furthermore, any dimensions recited or called out herein are for exemplary purposes only and are not meant to limit the scope of the invention in any way unless so recited in the claims.

Figure 2:
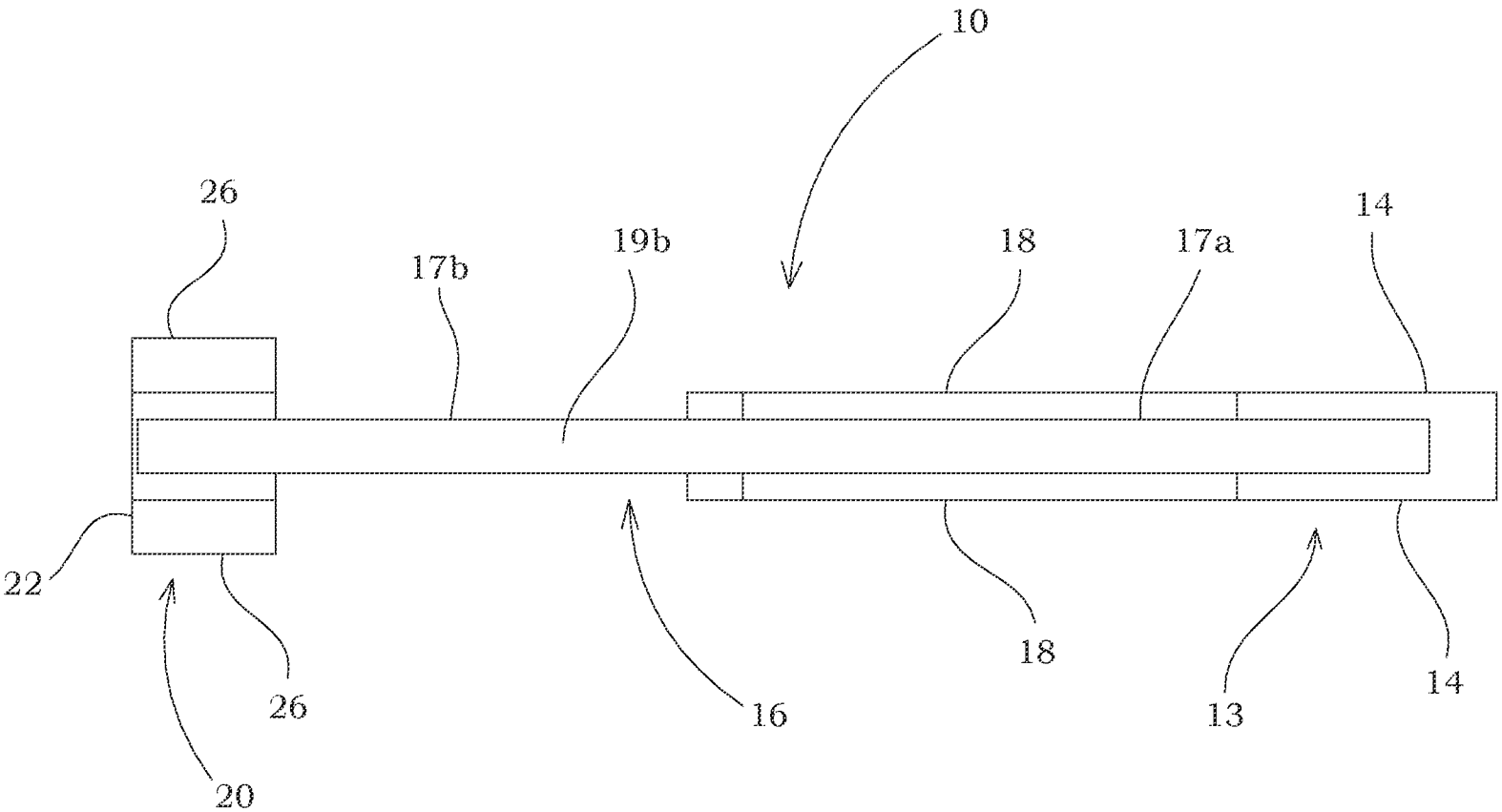
FIG. 2 provides a top view of the first embodiment of the curved hammer.

Referring now to the drawings, wherein like reference numerals designate identical or corresponding parts throughout the several views, FIG. 1 provides a perspective view of a first embodiment of the curved hammer 10 and FIG. 2 provides a top view thereof. As shown herein, the neck first end 17*a* of the neck 16 is affixed to a connection portion 13 of the curved hammer 10. The connection portion 13 in the first embodiment of the curved hammer 10 is formed with a rod hole 12 through the center of the connection portion 13. As is well known to those skilled in the art, the rod hole 12 is most often used to pivotally join the curved hammer 10 to a hammer pin or rod (neither shown), which hammer pins or rods often extend through plates (not shown) of a hammer mill assembly. These elements and their operation are not further described herein for purposes of clarity, but the patents incorporated by reference herein in the background provide more detail on such hammer mill assemblies.

In the first embodiment, the connection portion 13 is rounded, as best shown in FIG. 1. In the first embodiment, the outer diameter of the connection portion 13 is two and one-half inches. However, in other embodiments not pictured herein, the connection portion 13 may have other shapes, such as rectangular, triangular, elliptical, or otherwise without departing from the spirit and scope of the curved hammer 10. Furthermore, the relative dimensions and angles of the various elements of the curved hammer 10 may be adjusted for the specific application of the curved hammer 10, and therefore an infinite number of variations of the curved hammer 10 exist, and such variations will naturally occur to those skilled in the art without departing from the spirit and scope of the curved hammer 10.

A shoulder 14 may be positioned on the connection portion 13 surrounding the rod hole 12, as shown in the various embodiments pictured herein. The shoulder 14 provides increased strength and longevity to the curved hammer 10 in many applications, as is well known to those skilled in the art. In the various embodiments pictured herein, the shoulder 14 is positioned on both sides of the rod hole 12. However, in other embodiments not pictured herein, the shoulder 14 is positioned on only one side of the rod hole 12. The optimal dimensions of the shoulder 14 will vary depending on the specific application of the curved hammer 10, and are therefore in no way limiting to the scope of the curved hammer 10. In the first embodiment, the thickness of the shoulder 14 is 0.75 inches.

As best shown in FIG. 1, the neck 16 of the curved hammer 10 is non-linear. As shown in the first embodiment herein, the neck bottom surface 19*a* is derived from a circle having a radius of four and one-half inches, and the neck top surface 19*b* is derived from a circle having a radius of seven inches. As is apparent from FIG. 1, the circles from which the neck bottom surface 19*a* and neck top surface 19*b* are derived have offset center points (not shown). That is, the circle from which the neck bottom surface 19*a* is derived is positioned to toward the contact portion 20 with respect to the circle from which the neck top surface 19*b* is derived. Accordingly, as one progresses from the neck first end 17*a* to the neck second end 17*b*, the distance between the neck bottom surface 19*a* and neck top surface 19*b* decreases. In the first embodiment the center of the rod hole 12 is one inch below the neck bottom surface 19*a*, and the length of the curved hammer 10 from the center of the rod hole 12 to the primary contact surface 22 of the contact portion 20 is eight and one-quarter inches. The width of the neck 16 in the first embodiment is 0.375 inches. However, in other embodiments, whether pictured herein or otherwise, the overall length of the curved hammer 10 may be greater or less than that of the first embodiment depending on the configuration of the hammermill assembly (not shown) for which the curved hammer 10 is designed. Furthermore, the optimal width for the neck 16 will vary depending on the specific application of the curved hammer 10, which may depend on the type of material to be comminuted.

The neck 16 may also include a neck reinforcement 18, as shown in the various embodiments pictured herein. The neck reinforcement 18 serves to make the neck 16, and subsequently the entire curved hammer 10, more robust and increase the longevity thereof. In the first embodiment of the curved hammer 10 the thickness of the neck reinforcement 18 is 0.75 inches, which is equal to the thickness of the shoulder 14 in the first embodiment. However, the optimal dimensions of the neck reinforcement 18 will vary depending on the specific application of the curved hammer 10, and the thickness thereof need not necessarily be the same as the thickness of the shoulder 14. Accordingly, in embodiments not pictured herein, the thickness of the neck reinforcement 18 is greater than the thickness of the shoulder 14, and in other embodiments not pictured herein the thickness of the neck reinforcement 18 is less than the thickness of the shoulder 14. Furthermore, the distance the neck reinforcement 18 extends from the shoulder 14 towards the neck second end 17*b* and the width of the neck reinforcement 18 may be varied in an infinite number of configurations within the spirit and scope of the curved hammer 10. The neck reinforcement 18 may be included on both sides of the neck 16. However, in other embodiments not pictured herein, the neck reinforcement 18 may be included on only one side of the neck 16.

The neck second end 17*b* is affixed to the contact portion 20. The contact portion 20, which delivers energy to the material to be comminuted, includes a primary contact surface 22. The primary contact surface 22 is generally the face of the contact portion 20 that is adjacent the screen (not shown) during operation of a hammermill assembly. In the first embodiment the widest portion of the primary contact surface 22 is 1.5 inches. As shown in the various embodiments pictured herein, the surface area of the primary contact surface 22 of the curved hammer 10 is greater than that of prior art hammers. The increased surface area of the primary contact surface 22 increases the amount of work done by the curved hammer 10 per strike as compared to those of the prior art.

Figure 3:
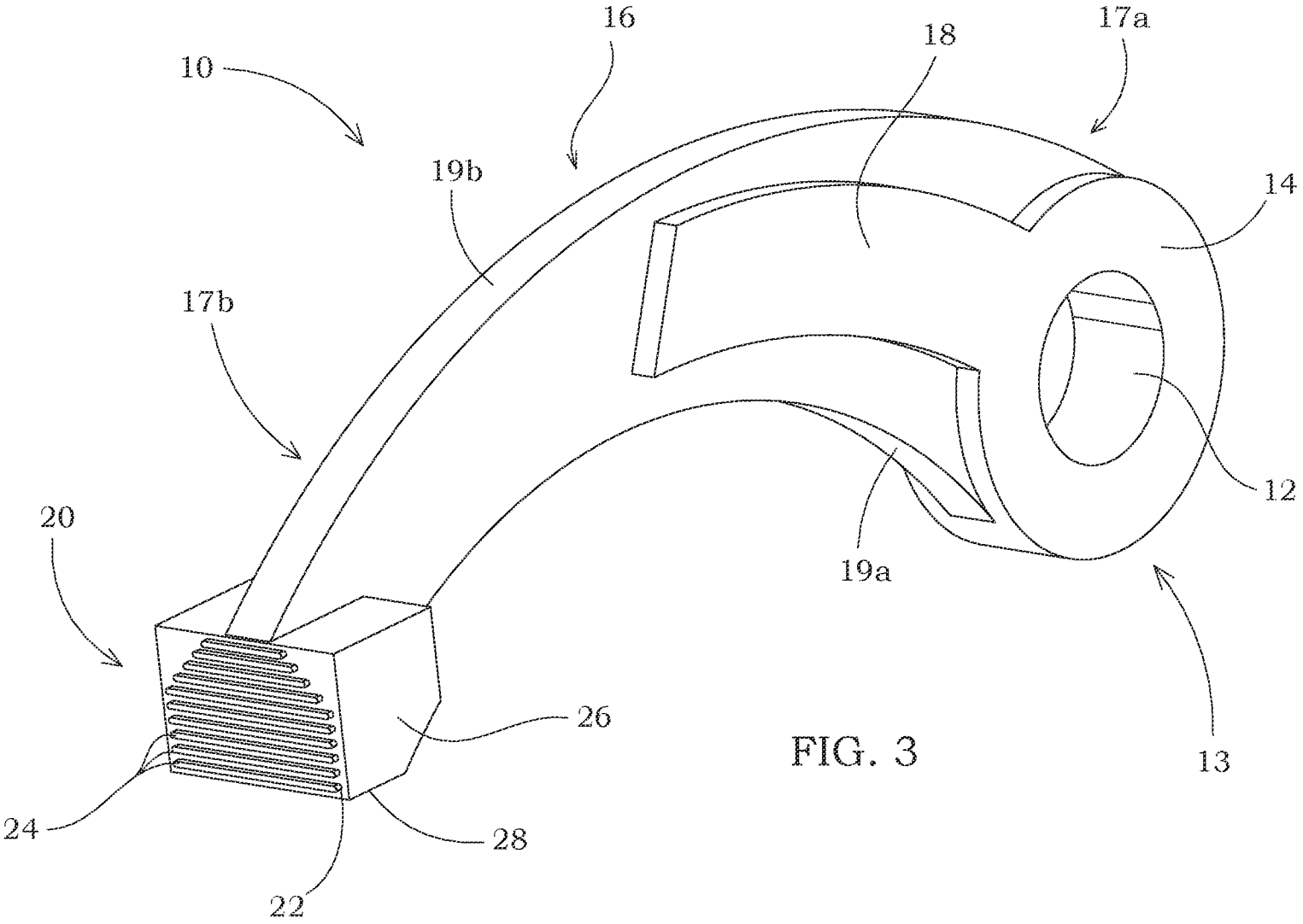
FIG. 3 provides a perspective view of a second embodiment of the curved hammer.
Figure 4:
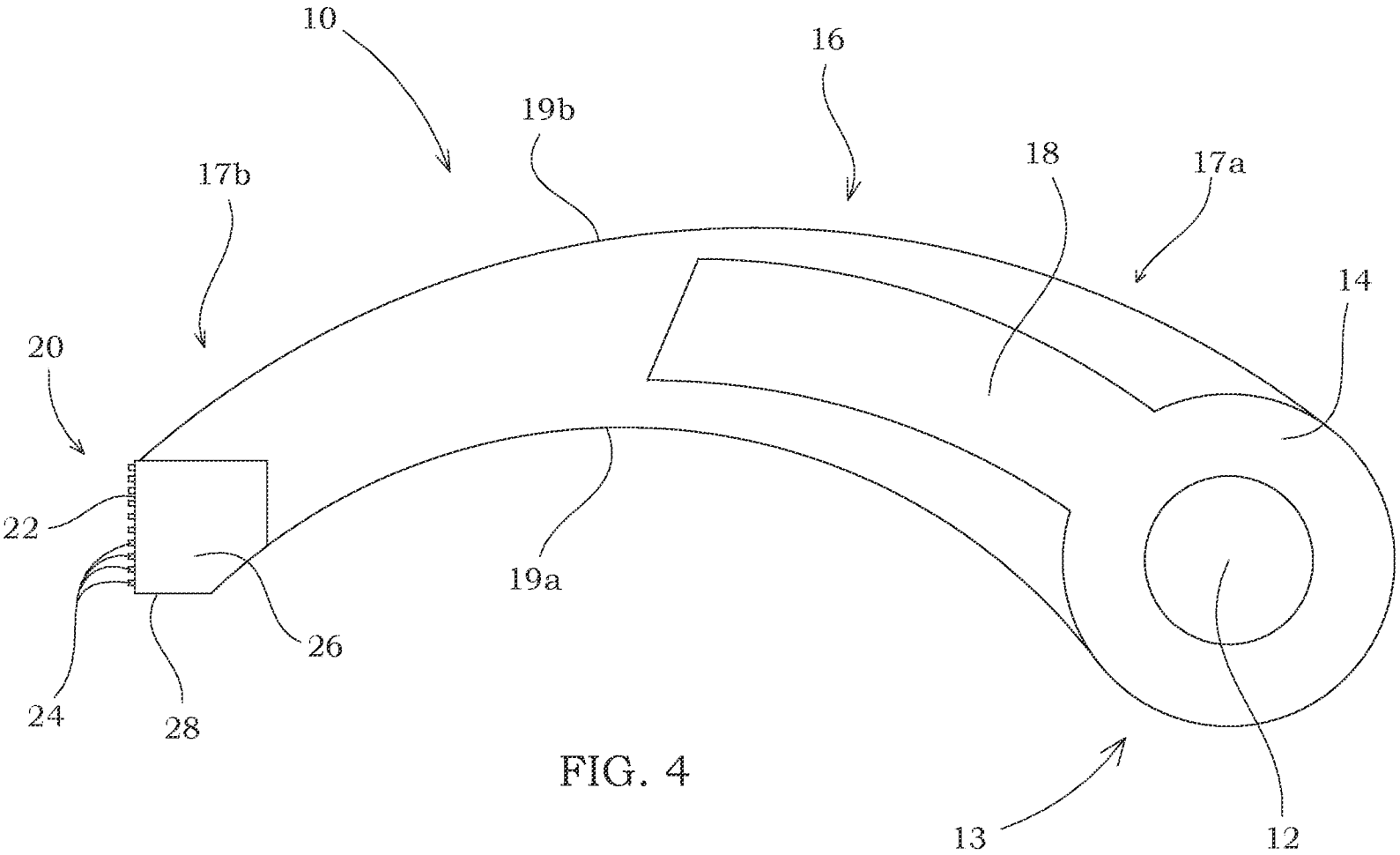
FIG. 4 provides a side view of the second embodiment of the curved hammer having a plurality of welds on the primary contact surface.

In the first embodiment the primary contact surface 22 forms an irregular hexagon, which is best shown in FIG. 1. However, the specific shape of the primary contact surface 22 is in no way limiting. For example, in the second embodiment of the curved hammer 10 as shown in FIGS. 3 and 4, the primary contact surface 22 is rectangular in shape. Accordingly, the primary contact surface 22 may have any shape suitable for the specific application of the curved hammer 10.

Figure 2A:
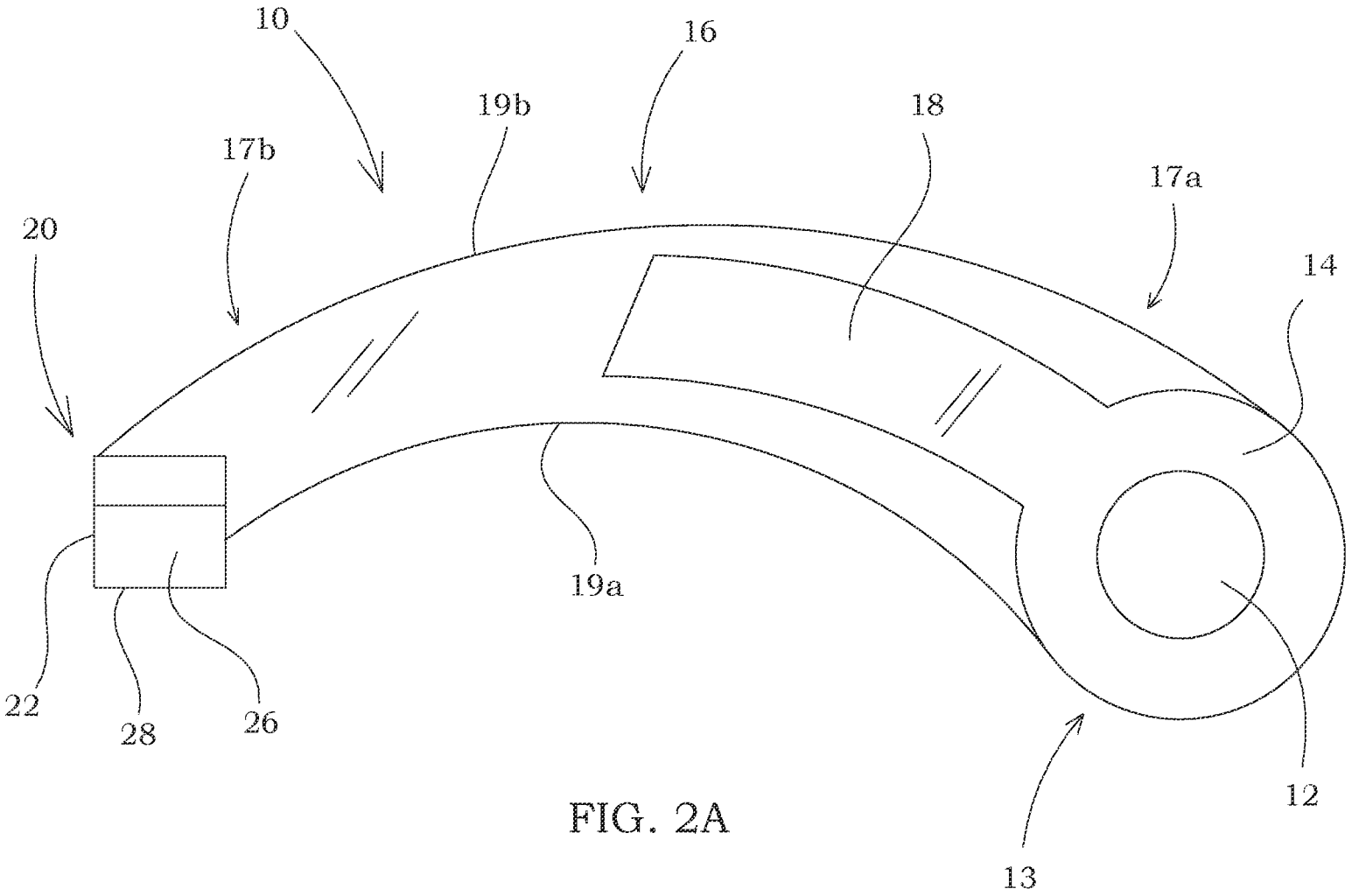
FIG. 2A provides a side view of the first embodiment of the curved hammer.

Another difference between the first and second embodiments is the shape of the side contact surface 26. A comparison of the side views of the first and second embodiments (shown in FIGS. 2A and 4, respectively) shows that the contact portion 20 in the first embodiment is different from that in the second embodiment. In the first embodiment, the side contact surface 26 (as shown in FIG. 2A) is primarily rectangular in shape, with the bottom contact surface 28 having the same width as the side contact surface 26. However, in the second embodiment, the side contact surface 26 (as shown in FIG. 4) is primarily pentagonal in shape, with a narrower bottom contact surface 28 as compared to the bottom contact surface 28 of the first embodiment.

In the second embodiment, the curvature of the neck bottom surface 19*a* continues through the contact portion 20 and terminates at the bottom contact surface 28. The surface of the contact portion 20 through which the neck bottom surface 19*a* extends may have the same curvature as that of the neck bottom surface 19*a*, as shown in FIG. 4. However, in other embodiments, different orientations, angles, or dimensions of the contact portion 20, primary contact surface 22, side contact surface 26, and bottom contact surface 28, may be present without departing from the spirit and scope of the curved hammer 10.

In the second embodiment of the curved hammer 10, a plurality of welds 24 is affixed to the primary contact surface 22. These welds 24 may be of a hardened material to increase the efficacy and longevity of the curved hammer 10. The materials used to create a weld 24 will vary depending on the specific application of the curved hammer 10, which includes consideration for the material to be comminuted, and variations will become apparent to those skilled in the art in light of the present disclosure. For example, a weld 24 may be constructed of steel, an iron alloy, an aluminum alloy, a tungsten alloy, another metallic alloy, or any combination thereof known to those skilled in the art. Additionally, welds 24 may be positioned on other surfaces of the contact portion 20, such as the bottom contact surface 28 and/or side contact surface 26.

Figure 5:
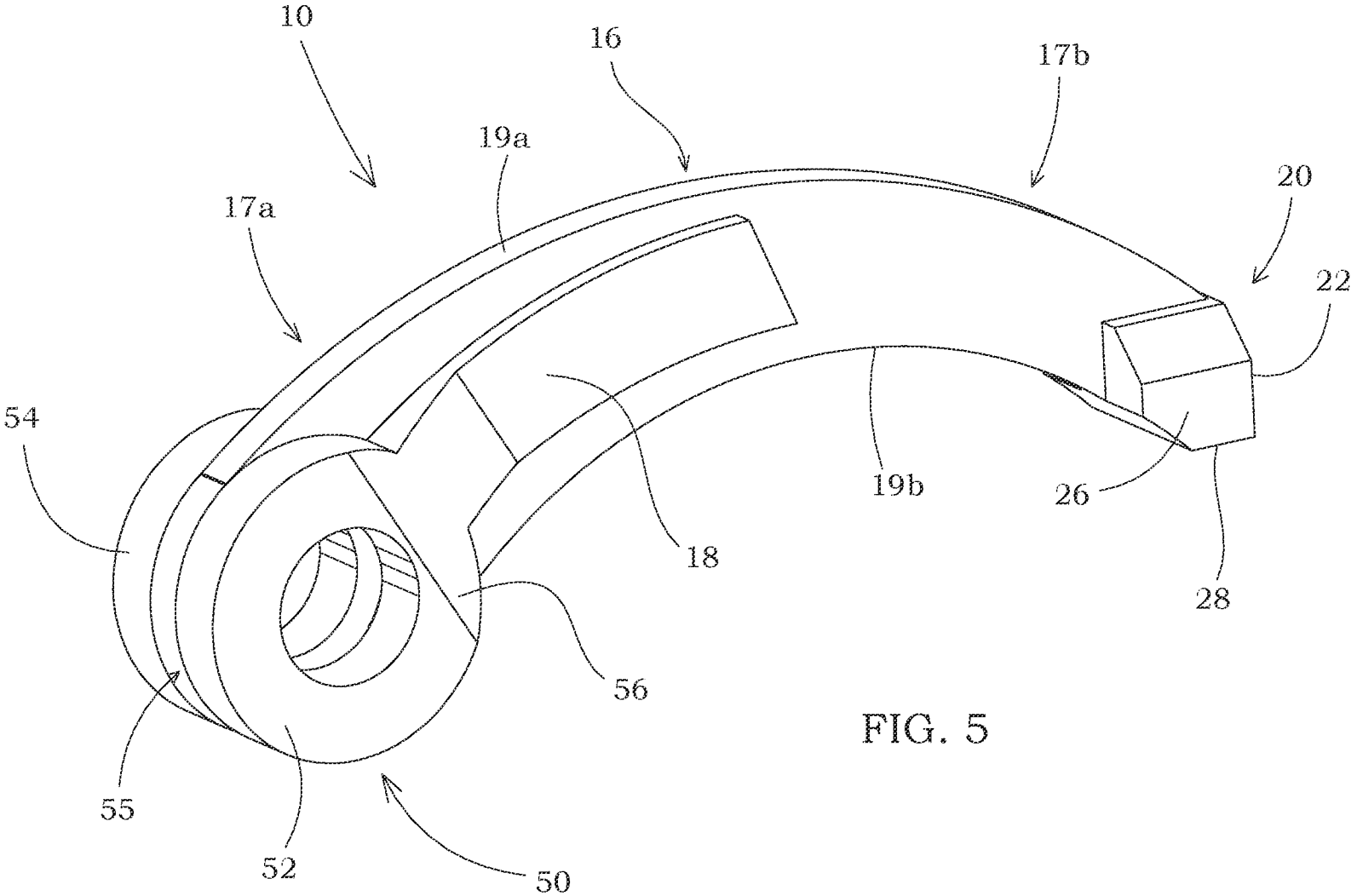
FIG. 5 provides a perspective view of a third embodiment of the curved hammer.
Figure 6:
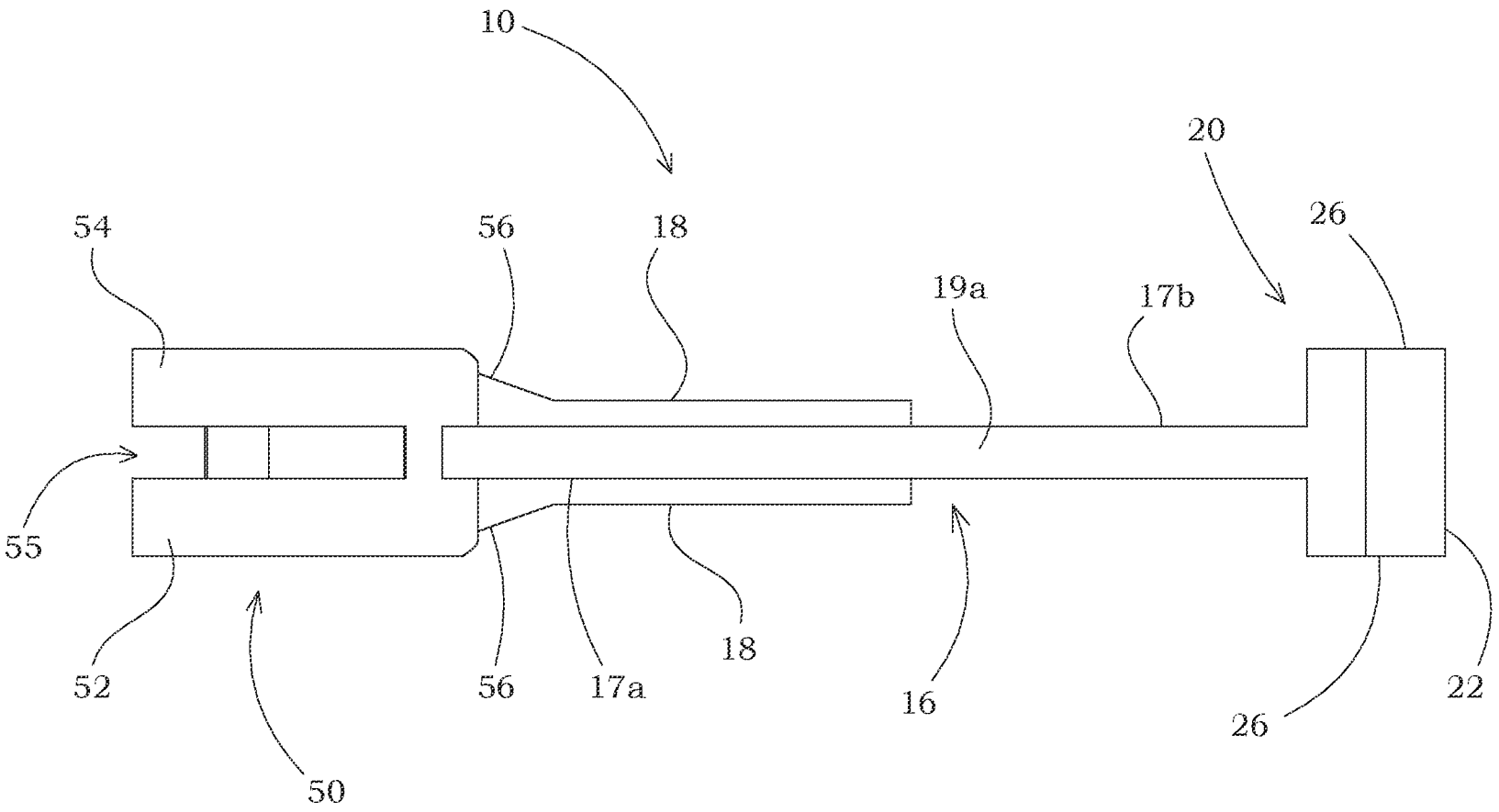
FIG. 6 provides a top view of the third embodiment of the curved hammer.

A third embodiment of the curved hammer 10 is shown in FIGS. 5 and 6. The third embodiment employs a contact portion 20 substantially the same as that of the second embodiment save for the welds 24 placed on the primary contact surface 22 in the second embodiment. The third embodiment employs a split connection portion 50 through which the rod hole 12 is positioned.

The split connection portion 50 is comprised of a first arm 52 and a second arm 54 with a void 55 positioned therebetween. The first and second arms 52, 54 may be generally symmetrical with respect to the void 55 as shown in FIG. 6. The void 55 extends approximately half the diameter of the rod hole 12 such that the portion of the rod (not shown) adjacent the void 55 when the curved hammer 10 is engaged with a hammermill assembly is unobstructed by the curved hammer 10. This void 55 adjacent the rod allows grain to migrate away from the rod during use.

The third embodiment includes a tapered shoulder 56 positioned on the first arm 52 and a tapered shoulder 56 positioned on the second arm 54, wherein both tapered shoulders 56 are positioned opposite the void 55 and the respective arms 52, 54. In the third embodiment, the total width of the split connection portion 50 (the distance from the exterior surface of the first arm 52 to the exterior surface of the second arm 54) is approximately equal to the width of the contact portion 20. However, the configuration, specific dimensions, and angles of the connection portion 13 and tapered shoulder 56 may vary from one embodiment of the curved hammer 10 to the next, and therefore are in no way limiting to the scope thereof.

The precise distance the void 55 extends through the rod hole 12 may be different in different embodiments not pictured herein, and is therefore in no way limiting to the scope of the curved hammer 10. Furthermore, the precise width of the void 55 (i.e., the distance between the interior surfaces of the first and second arms 52, 54) may be different from one embodiment to the next. In embodiments of the curved hammer 10 not pictured herein, the first and second arms 52, 54 may extend past the rod hole 12 in the direction opposite the neck second end 17*b* by an amount greater than that shown for the third embodiment pictured herein.

The curved hammer 10 may be installed in a hammermill assembly to rotate in any direction. However, it is contemplated that from the vantage shown in FIGS. 2A and 4, the curved hammer 10 will rotate in a counterclockwise direction. Accordingly, with most embodiments of a hammermill assembly in the prior art, the curved hammer 10 allows the primary contact surface 22 to remain substantially normal to the screen (not shown) of the hammermill assembly, which increases the efficiency of the comminution of the material. The curved hammer 10 is more efficient because when the primary contact surface 22 remains substantially normal to the screen, the entire surface area of the primary contact surface 22 may work to comminute material.

The materials used to construct the connection portion 13, shoulder 14, neck 16, neck reinforcement 18, and contact portion 20 will vary depending on the specific application for the curved hammer 10. Certain applications will require a high tensile strength material, such as steel, while others may require different materials, such as carbide-containing alloys. Accordingly, the above-referenced elements may be constructed of any material known to those skilled in the art, which material is appropriate for the specific application of the curved hammer 10, without departing from the spirit and scope of the curved hammer as disclosed and claimed herein.

Other methods of using the curved hammer 10 and embodiments thereof will become apparent to those skilled in the art in light of the present disclosure. Accordingly, the methods and embodiments pictured and described herein are for illustrative purposes only. The curved hammer 10 also may be used in other manners, and therefore the specific hammermill in which the curved hammer 10 is used in no way limits the scope of the curved hammer.

It should be noted that the curved hammer 10 is not limited to the specific embodiments pictured and described herein, but is intended to apply to all similar curved hammers 10. Modifications and alterations from the described embodiments will occur to those skilled in the art without departure from the spirit and scope of the curved hammer 10.

The invention claimed is:

1. A metallic based hammer comprising:

a. a split connection portion, said split connection portion including a first arm and a second arm separated by a void;

b. a rod hole centered in said split connection portion;

c. a neck having a first and second end, said neck first end connected to said split connection portion, wherein said neck is connected to said split connection portion adjacent said void, and wherein the thickness of said split connection portion is greater than the thickness of said neck; and d. a contact portion connected to said neck second end and having at least one weld positioned on said contact portion, wherein the thickness of said contact portion is greater than the thickness of said neck.

2. The metallic based hammer according to claim 1 wherein said metallic based hammer further comprises a first shoulder positioned around said rod hole on said first arm and a second shoulder positioned around said rod hole on said second arm.

3. The metallic based hammer according to claim 2 wherein said first and second shoulders are further defined as being tapered along the thickness of said hammer in a direction from said split connection portion to said contact portion.

4. The metallic based hammer according to claim 1 wherein said contact portion is substantially rectangular in shape.

5. The metallic based hammer according to claim 1 wherein said neck is further defined as being curved downward from said neck first end to said neck second end.

6. The metallic based hammer according to claim 1 wherein said metallic based hammer is further defined has being symmetrical about its length with respect to a plane parallel to and bisecting said void.

7. The metallic based hammer according to claim 1 wherein said metallic based hammer further comprises a neck reinforcement positioned along a portion of said neck.

8. The metallic based hammer according to claim 1 wherein said at least one weld increases the thickness of said contact end.

9. The metallic based hammer according to claim 1 wherein said at least one weld causes the thickness of said contact end to be greater than the thickness of said neck.

* * * * *